US008921770B1

(12) United States Patent
Muntean et al.

(10) Patent No.: US 8,921,770 B1
(45) Date of Patent: Dec. 30, 2014

(54) REDUCTION OF CROSS-TALK BETWEEN RF COMPONENTS IN A MASS SPECTROMETER

(71) Applicant: Bruker Daltonics, Inc., Billerica, MA (US)

(72) Inventors: Felician Muntean, Danville, CA (US); Roy Moeller, San Leandro, CA (US); Stephen Zanon, Campbell, CA (US)

( * ) Notice: Subject to any disclaimer, the term of this patent is extended or adjusted under 35 U.S.C. 154(b) by 0 days.

(21) Appl. No.: 13/935,732

(22) Filed: Jul. 5, 2013

(51) Int. Cl.
*H01J 49/42* (2006.01)
*H01J 49/06* (2006.01)

(52) U.S. Cl.
CPC ..... *H01J 49/06* (2013.01)
USPC ..... 250/281; 250/282; 250/288

(58) Field of Classification Search
USPC ..... 250/281
See application file for complete search history.

(56) References Cited

U.S. PATENT DOCUMENTS 6,121,607 A * 9/2000 Whitehouse et al. ..... 250/288
6,919,562 B1 * 7/2005 Whitehouse et al. ..... 250/288

* cited by examiner

*Primary Examiner* — Phillip A Johnston
(74) *Attorney, Agent, or Firm* — Robic, LLP

(57) ABSTRACT

The invention generally relates to an assembly of a first RF component and a second RF component in a mass spectrometer, the first RF component comprising a first set of electrodes and the second RF component comprising a second set of electrodes, wherein the RF components are located and aligned end-to-end to one another, and wherein a transverse dimension of the electrodes of the first set is smaller than that of the electrodes of the second set. The assembly further comprises a conductive electric field screen located at an outer periphery of the first set of electrodes and facing the electrodes of the second set as to reduce RF electric field cross-talk between the electrodes of the first set and those of the second set. The invention affords for technically simple and economic means to reduce cross-talk or capacitive coupling between adjacent RF components in a mass spectrometer.

18 Claims, 9 Drawing Sheets

REDUCTION OF CROSS-TALK BETWEEN RF COMPONENTS IN A MASS SPECTROMETER

BACKGROUND OF THE INVENTION

1. Field of the Invention

This invention relates generally to the field of mass spectrometry and, more specifically, to the reduction of cross-talk between RF components of a mass spectrometer.

2. Description of the Related Art

Nowadays, RF components are standard devices for use in mass spectrometry. Examples of RF components used in a mass spectrometer include multipole ion guides, multipole mass analyzers (sometimes also called mass filters), pre/post filters, multipole collision cells, and multipole ion traps. Such RF components may be implemented using a configuration having an even number of elongate pole electrodes arranged equi-angularly on a circular perimeter about a common axis. This axis may be linear or non-linear, such as curved. Some mass spectrometers use RF components in tandem or adjacent to one another. Examples of such tandem devices can be found in U.S. Pat. No. 6,191,417 B1 (Douglas et al.) and U.S. Pat. No. 6,340,814 B1 (John Vandermey) where a tandem quadrupole mass filter assembly is disclosed. U.S. Pat. No. 6,576,897 B1 (Steiner et al.) shows a triple quadrupole mass analyzer with a curved ion collision cell which is operated in a so-called RF only mode.

The close proximity of the RF components results in RF coupling or cross-talk therebetween, which causes unwanted perturbations from one RF component on the other adjacent RF component. As a result of these external perturbations, the system performance of the mass spectrometer is degraded. For example, external perturbations on a mass analyzer as a consequence of RF coupling with an adjacent RF component can cause the mass resolution of the mass analyzer to change. Because resolution is related to the ion transmission of the mass analyzer, the overall sensitivity of the measurement will also be affected, which is undesirable.

One approach of overcoming the issues associated with cross-talk between adjacent RF components is placing one or more electrostatic lenses between them. A lens usually consists of a conductive sheet with an aperture and provides a shielding or screening effect impeding the RF voltages of one RF component cross-talking to the other RF component and vice versa. However, due to the lenses being arranged in between the end-faces of the adjacent RF components they also influence the ion transmission characteristics by, for instance, reducing the geometrical acceptance of the respective downstream RF component and also by creating an additional surface where stray ions can hit, charge-up and create an electric field distortion. The latter, in particular, increases the optimization complexity of the instrument.

Another approach of overcoming cross-talk or capacitive coupling is described in U.S. Pat. No. 8,314,385 B2 (Roy Moeller). Some of the electrodes of one RF component are provided with axial extensions which in part spatially overlap with angularly offset electrodes of the other RF component, however, without establishing electrical contact therewith. The overlap area and distance between extensions and electrodes is chosen such as to compensate for, preferably any, capacitive coupling between the adjacent RF components. This design generally works well, but requires additional effort and expense when fabricating the multipole electrodes to also include the extensions, and properly align them with those of another multipole RF component.

Hence, there is still a need for technically simple and economic means to reduce cross-talk or capacitive coupling between adjacent RF components in a mass spectrometer, however, without suffering the negative effects of geometrical acceptance degradation and/or (too much) electric field distortion.

SUMMARY OF THE INVENTION

The invention relates generally to an assembly of a first RF component and a second RF component in a mass spectrometer, the first RF component comprising a first set of electrodes and the second RF component comprising a second set of electrodes, wherein the RF components are located and aligned end-to-end to one another, and wherein a transverse dimension of the electrodes of the first set is smaller than that of the electrodes of the second set, the assembly further comprising a conductive electric field screen located at an outer periphery of the first set of electrodes and facing the electrodes of the second set as to reduce RF electric field cross-talk between the electrodes of the first set and those of the second set and vice versa.

With such an arrangement, the benefits of placing RF components in close proximity, such as high ion transmission from one RF component to the other, can be kept without suffering from impairments associated with other conventional arrangements, such as cross-talk in a lens-free and screen-free design or reduced geometrical acceptance in a lens-containing design, for instance.

In one embodiment, the electric field screen may be grounded. Alternatively, the electric field screen can be supplied with at least one of tunable RF and tunable direct current (DC) voltages. In such a case, at least one of the tunable RF and tunable DC voltages supplied to the electric field screen is preferably coordinated with at least one of RF and DC voltages supplied to the first or second set of electrodes. Alternatively, the electric field screen is maintained substantially at a DC bias potential applied uniformly to the electrodes of the first set.

In various embodiments, the first RF component is one of a multipole mass analyzer, a pre/post-filter, a multipole ion guide, a multipole collision cell, and a multipole ion trap and the second RF component is one of a multipole mass analyzer, a pre/post-filter, a multipole ion guide, a multipole collision cell, and a multipole ion trap. The beneficial effect of cross-talk elimination will be achieved with any assembly comprising an arbitrary combination of the aforementioned elements.

A longitudinal distance between the first and second sets of electrodes may be smaller than an inscribed radius of an inner width formed in between the electrodes of one of the first set and the second set.

In various embodiments, the inner width formed in between the electrodes of the first set can be different in one of shape and dimension from that formed in between the electrodes of the second set, preferably such that the end-faces of the electrodes in the two electrode sets feature little overlap, if any.

In further embodiments, the opposing front ends of the electrodes of at least one of the first set and second set can be modified by one of being hollow and being recessed at a side facing away from the inner width formed in between the electrodes, as to decrease the conductive mass and thereby reduce a cross-talk magnitude.

A side of the electric field screen facing the electrodes of the second set may be positioned about flush with an end-face of the electrodes of the first set in order to keep the influence of the electric field screen on the fringe fields formed in the gap between the end-faces of the opposing electrode sets low.

In various embodiments, the electric field screen can be one of an integral sheet member and mesh member, having a central aperture with a dimension as to accommodate the electrodes of the first set.

In one embodiment, the central aperture can resemble a clover leaf with a number of concave recesses that corresponds to a number of electrodes to be accommodated in the aperture. The recesses are preferably arranged such that they lie between the electrodes of the first set as to prevent electrostatic charging by stray ions. Alternatively, the central aperture may be one of circular and rectangular; in each case dimensioned such as to neatly fit the electrodes within. In a further variant the central aperture has the contour of a polygon whose sides closely surround the outer periphery of the electrodes of the first set.

In further embodiments, the electric field screen may comprise a number of two-dimensional members that is equal to a number of electrodes in the first set, each two-dimensional member being associated with one of the electrodes of the first set and effectively screening cross-talk thereto and therefrom. Preferably, the members are electrically connected to one another as to maintain a uniform electric potential at any time.

It is possible to locate at least one non-conductive spacer between an outer circumference of the electrodes of the first set and the electric field screen in order to reliably guarantee electrical insulation therebetween.

In various embodiments, an end-face of a front end of the electrodes of the first set can partially overlap with that of the electrodes of the second set when viewed along an axis of the assembly.

It is to be understood that the first set and the second set of electrodes each may comprise one of four, six, eight, ten, and twelve electrodes to form a quadrupole, hexapole, octopole, decapole, and dodecapole configuration, respectively.

BRIEF DESCRIPTION OF THE DRAWINGS

The invention can be better understood by referring to the following figures. The elements in the figures are not necessarily to scale, emphasis instead being placed upon illustrating the principles of the invention (often schematically). In the figures, corresponding parts are generally designated by identical last two digits of the reference numerals throughout the different views.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1A:
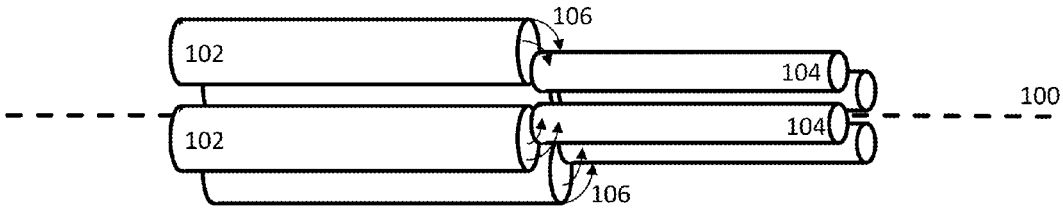
FIGS. 1A to 1C illustrate an end-to-end arrangement of two quadrupole rod sets.
Figure 1B:
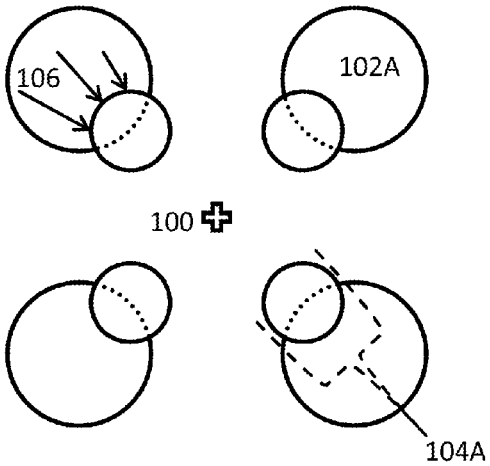
Figure 1C:
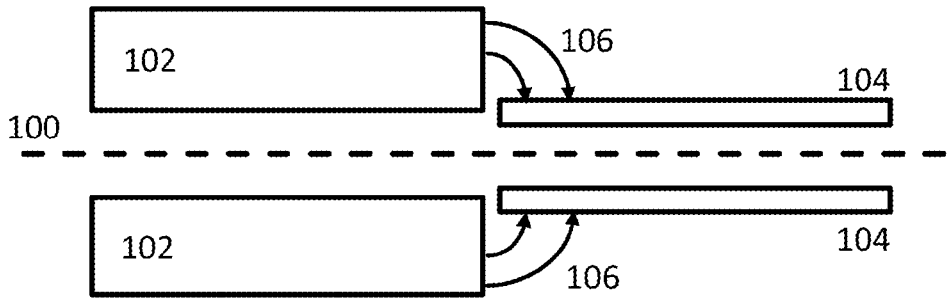

FIGS. 1A to 1C schematically show a lens-free and screen-free tandem quadrupole assembly in different views. FIG. 1A depicts a pseudo-isometric view; FIG. 1B a front-end view from right to left as seen in FIG. 1A; and FIG. 1C a plain lateral view.

In this example, the transverse dimension of the pole electrodes in relation to the longitudinal axis 100 differs between the two quadrupoles so that there is one quadrupole with thick electrodes 102 (FIGS. 1A and 1C: on the left) and another quadrupole with thin electrodes 104 (FIGS. 1A and 1C: on the right). The pole electrodes 102, 104 displayed uniformly have the shape of rods and as such a circular cross section which, however, is not crucial for the concept of the invention. Other electrode designs having different cross section shapes, such as hyperbolic or rectangular flat, are readily apparent to one of skill in the art. As the front end portions of each set of pole electrodes 102, 104 are directly exposed to the electric fields emanating from the counterpart pole electrodes of the respective opposing set of electrodes due to the application of RF and DC voltages thereto (electrical contacts not shown for the sake of simplicity), the two quadrupoles are cross-talking to each other. Due to the different transverse dimensions of the pole electrodes 102, 104 in this example, a large portion of this cross-talk originates from the end-faces 102A of the thick pole electrodes 102 interacting with the end-faces (in a region of overlap) and the lateral outer parts 104A of the thin pole electrodes 104, as indicated by the arrows 106.

The effects of such cross-talk have been investigated on a tandem quadrupole assembly similar to the one depicted in FIGS. 1A to 1C, wherein the quadrupole with the thick electrodes was configured to operate as a mass analyzer, Q1, and the adjacent quadrupole with the thin electrodes was configured to operate as collision cell (for collisional cooling and/or collision-induced dissociation), Q2. Such configuration is standard in triple quadrupole mass analyzer assemblies, Q1-Q2-Q3, for instance. The effect of the RF voltages at the collision cell Q2 on the mass resolution of the adjacent mass analyzer Q1 becomes apparent from FIG. 1D which shows the peak width at full width at half maximum in atomic mass units (AMU) for a mass of m/z 264 as a function of the peak-to-peak RF voltage amplitude (in volts) supplied to the collision cell. As evident from the plot, with rising RF voltage amplitude the peak width increases almost six-fold in the range displayed. This entails a variability of the mass analyzer properties that is undesirable and that a practitioner in the field tries to avoid.

Figure 2A:
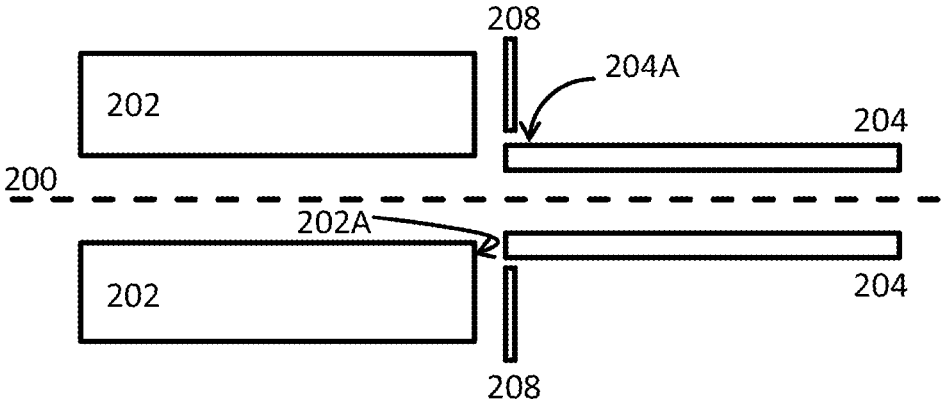
FIGS. 2A and 2B illustrate exemplary embodiments of a tandem multipole assembly according to principles of the invention.
Figure 2B:
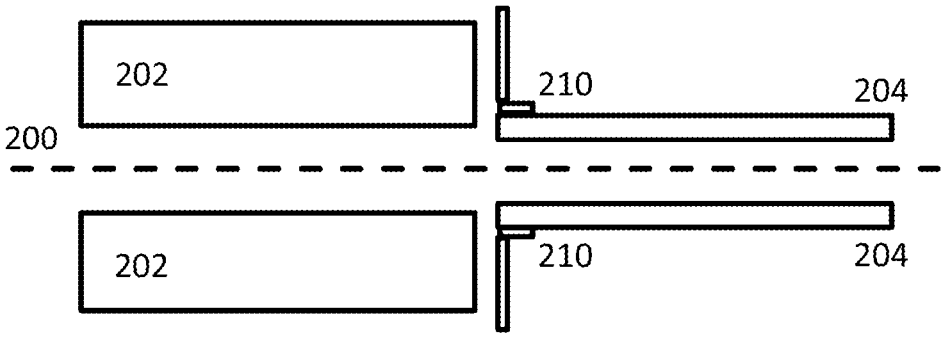

FIGS. 2A and 2B show different embodiments according to principles of the present invention. FIG. 2A shows a lateral view similar to the one depicted in FIG. 1C. In this case, however, a conductive screen 208 is placed at the outer periphery of the front-end portion 204A of the thin electrodes 204 in a manner that no electric contact exists between the screen 208 and the thin electrodes 204. For this purpose the screen 208 can be fixed mechanically to a separate mount (not shown), for example. An alternative embodiment would include placing a spacer (or spacers) 210 between the screen 208 and the electrodes 204 as illustrated in FIG. 2B, in order that the screen 208 can be supported by the electrode(s) 204 itself (themselves) without additional mounting means. The side face of the screen 208 opposing the end-faces 202A of the thick electrodes 202 is arranged about flush with the end-faces of the thin electrodes 204 in this example. However, advantageous screening effects might already be discernible if the electrodes 204 slightly protrude through the central aperture to the other side of the screen 208; that is slightly shifted to the left when looking at FIGS. 2A and 2B. Likewise it is possible to locate the end-faces of the thin electrodes 204 such that they are slightly set back from the aperture of the screen 208; that is slightly shifted to the right when looking at FIGS. 2A and 2B.

As apparent from the drawings, in general, the screen 208 is positioned and aligned such that it faces the end-faces 202A of the thick electrodes 202, thereby creating a substantial overlap between the side surfaces of the screen 208 and the end-faces of the thick electrodes 202 when viewed along the longitudinal axis 200 of the assembly. The screen 208 is preferably maintained at the same DC bias potential as the thin electrodes 204, at the periphery of which it is located, although in certain embodiments the screen can also be electrically connected to ground or a source (or sources) of RF and/or DC voltages (not shown), which should be tunable, in order that particularly favorable ion transmission properties can be set or adjusted either automatically or manually by an operator.

Figure 2C:
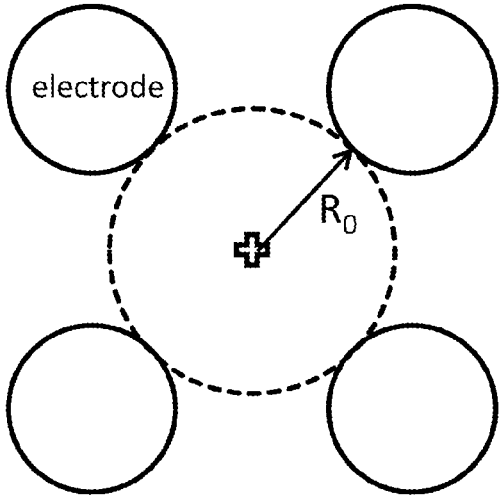
FIG. 2C illustrates the concept of an inscribed radius in between the electrodes of a quadrupole assembly.

It is to be noted that in the embodiments of FIGS. 2A and 2B the longitudinal distance between the first and second sets of electrodes 202, 204 is smaller than the radius $R_0$ of a circle inscribed (as shown in FIG. 2C) between the electrodes 202, 204 of either of the first set or the second set. With such an arrangement, the ion transmission efficiency can be favorably increased. It goes without saying that a similar concept holds for multipole electrode sets with higher electrode number, such as hexapole, octopole and the like.

Figure 1D:
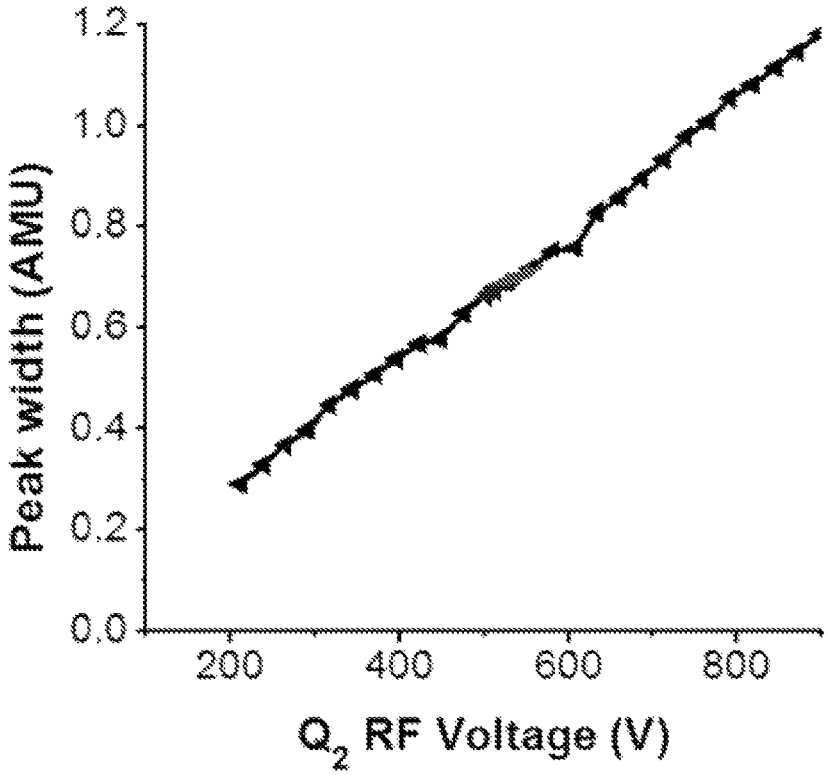
FIG. 1D illustrates a plot of the peak width in a mass analyzer, Q1, as a function of the peak-to-peak RF voltage applied to an adjacent collision cell, Q2, in a conventional triple quadrupole mass analyzer assembly, for instance.
Figure 2D:
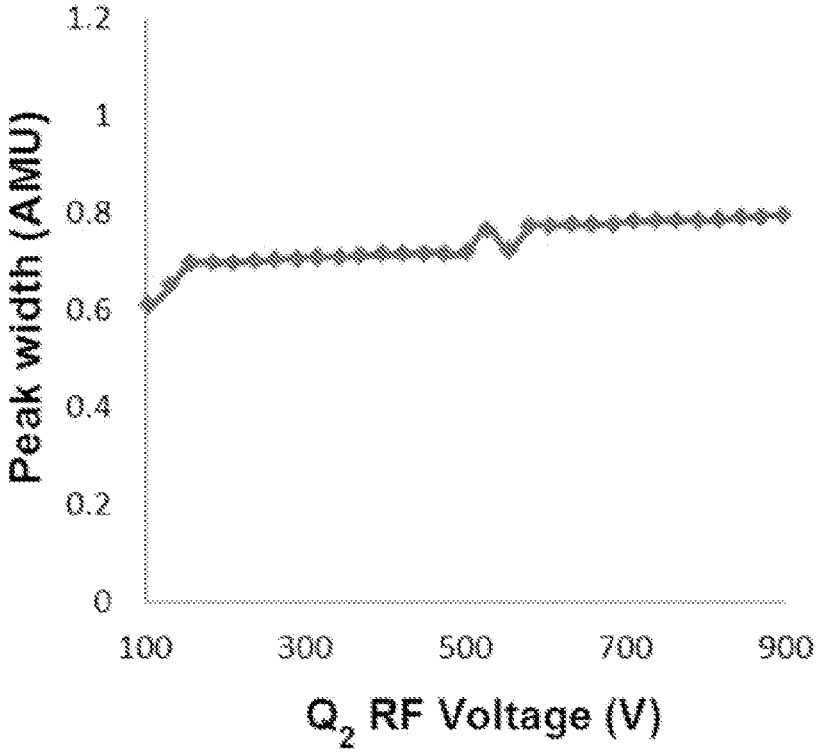
FIG. 2D illustrates a plot similar to the one shown in FIG. 1D, however acquired with a tandem assembly according to principles of the invention.

As readily apparent from the figures, the screen 208 by virtue of its position and electrical properties does effectively block a large proportion of the cross-talk between the adjacent electrodes 202, 204, in particular owing to the restricted "field-of-view" between the front end portions 202A, 204A of the electrodes 202, 204. The effect of the screen 208 on the peak width behavior in a mass analyzer Q1 with changing RF voltages at a collision cell Q2, as set out with respect to FIG. 1D, is shown in FIG. 2D under essentially the same measurement conditions, however with a target peak width of about 0.7 AMU, as this is a resolution setting often used with standard applications. Although a slight positive slope with rising RF peak-to-peak amplitude is still discernible in the exemplary plot shown, it is evident that the impact of the cross-talk between the two adjacent quadrupoles is reduced significantly, to the point where the effect of the resolution change on the mass analyzer sensitivity becomes negligible. The tiny slope might be attributable to those parts of the front end portions 202A, 204A of the electrodes 202, 204, such as the overlapping part of the end-faces, which are not screened from one another; in other words, those parts close to the inner width formed between the electrodes 202, 204. In any case, the contribution of the outer lying portions of the electrodes 202, 204 to the overall cross-talk magnitude is eliminated leading to much more stable, and therefore predictable, mass analysis properties regardless of the RF voltage applied to the collision cell Q2 in this assembly. Thereby, the whole system performance is unaffected by the cross-talk between a mass analyzer and an adjacent collision cell.

Further advantages of the screen 208 being located at the outer periphery of the thin electrodes 202 are that it does not impose any geometrical restriction on the acceptance of the respective downstream RF component, thereby keeping ion transmission rates favorably high, and that it hardly, if at all, influences the fringe fields in the gap between the adjacent RF components created by the combined RF and DC voltages effective therein. Thereby, the tuning of the ion transmission properties in the mass spectrometer is rendered easier to predict and handle.

Figure 3:
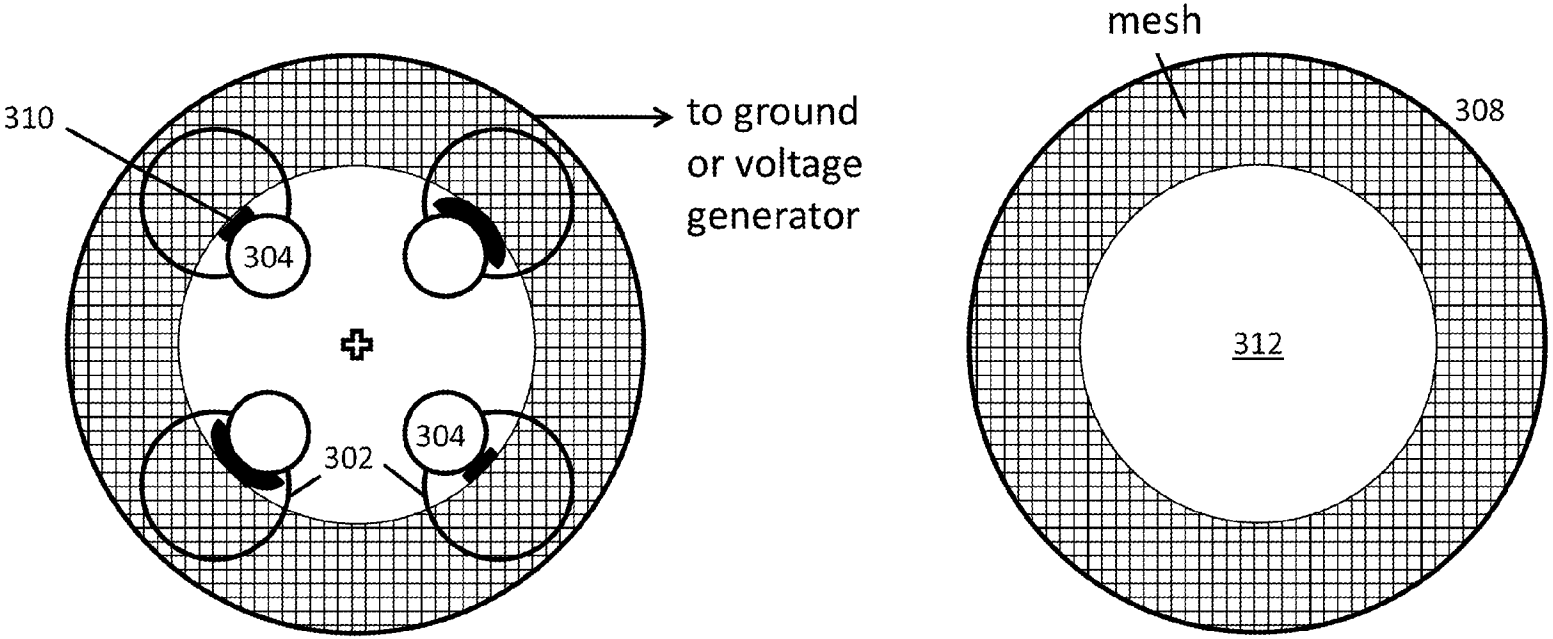
FIGS. 3, 4A, 4B, 4C, 5 as well as FIG. 6 illustrate different exemplary embodiments of an electric field screen according to principles of the invention.

FIG. 3 shows an exemplary embodiment of an electric field screen 308. On the left, it basically shows a front-end view from the side of the RF component with the small transverse dimension electrodes similar to the one in FIG. 1B; on the right, the screen is displayed isolated. As indicated the screen 308 can be electrically connected to ground or a voltage generator in order to improve the screening effect. Alternatively, it could be kept at the same DC potential as the adjacent thin electrodes 304.

The screen 308 can comprise an integral plate or mesh (as shown), made from conductive material, such as a metal, having a central aperture 312 which is dimensioned such as to accommodate the front ends of the RF component with the thin electrodes 304. The central aperture 312 may have a circular (as shown) or generally rectangular, in particular quadratic, shape. Similarly, the outer contour of the screen 308 can be circular (as shown) or quadratic, or can have any other suitable shape. An advantage of the circular aperture 312 shown in FIG. 3 could be seen as allowing electrodes with a round outer contour to fit neatly into the curvature of the central aperture 312. It goes without saying that this exemplary embodiment could even be improved by adapting the opposing inner and outer contours to one another, respectively.

The embodiment shown in FIG. 3 provides a ring-shaped frame (or in a modified version with different outer contour, a rectangular frame), the flat side faces of which are effective in shielding a major portion of cross-talk from one RF component to the adjacent RF component. FIG. 3 also shows an example of how, optionally, spacers 310 of different shapes could be used to avoid any short-circuit between electrodes 304 and screen 308. Some spacers may have a simple straight design (top left; bottom right). Other alternatives include a shape adapted to the inner and outer contours of screen aperture and electrodes, respectively, such as the arc-shaped or curved one in the embodiment shown in FIG. 3 (top right; bottom left).

Figure 4A:
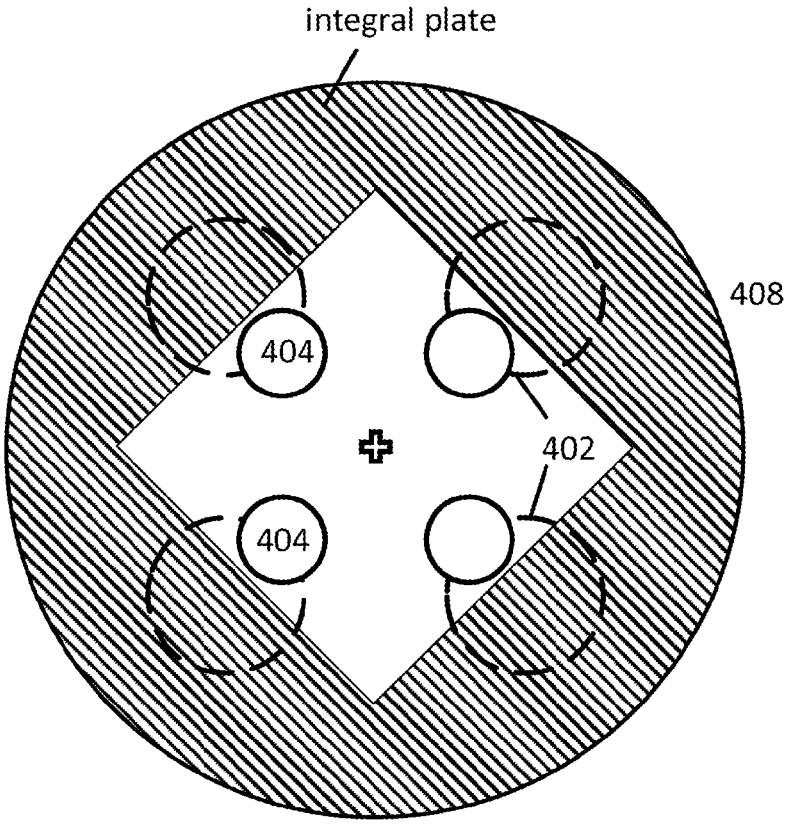

FIG. 4A shows an embodiment of a screen 408, consisting of a solid plate or sheet, with a circular round outer contour and quadratic inner contour of the central aperture. The corners of the inner quadratic contour are arranged to be far from the thin electrodes 404, which are each close to the middle of a different side of the square. This alignment has the advantage that, between adjacent electrodes, the screen 408 is recessed from the inner width in between the thin electrodes 404 where the ions pass so that the risk of stray ions hitting the screen 408 (and thereby giving rise to issues with electrostatic charging) is reduced.

Figure 4B:
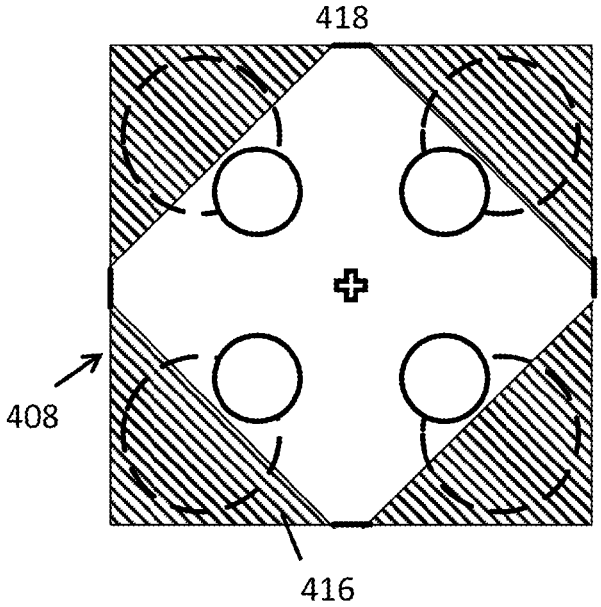

FIG. 4B shows an embodiment similar to the one in FIG. 4A; a notable difference being the cut-down size of the electric field screen 408 in order to allow for maximum overlap of the sides of the screen 408 with the end-faces of the thick electrodes 402 while at the same time requiring only a minimum of material usage. The four two-dimensional members 416 of triangular shape that together make up the assembly of the electric field screen 408 in this example can be connected via conductive bridges 418 in order to establish the same electric potential on all four of those members 416. Alternatively, the four members 416 can be electrically contacted separately, however with the aim of being held at the same electric potential.

Figure 4C:
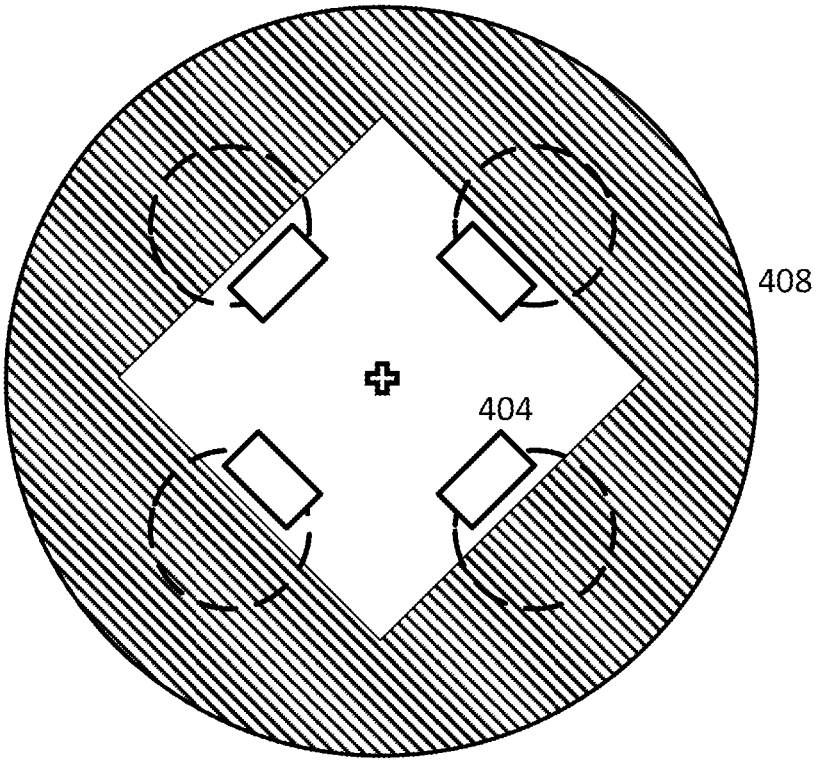

FIG. 4C shows another variant of FIG. 4A; the notable difference including a different shape or cross section of the thin electrodes 404, rectangular in this case. This allows placing the screen 408 as close as possible to the thin electrodes 404, a minimum distance chosen such as to reliably prevent electric arcing during operation. As has been described before, insulating spacers (not shown) could optionally be positioned between the thin electrodes 404 and the screen 408 so as to guarantee electrical insulation.

Figure 5:
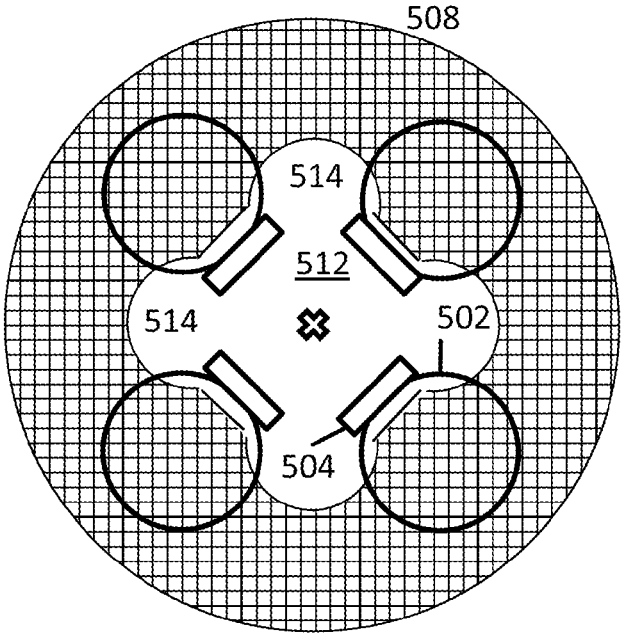

FIG. 5 shows another alternative of the screen configuration and includes, in particular, a modification of the shape and inner contour of the central aperture 512. The outer contour of the screen 508 can be implemented in accordance with the examples shown in FIGS. 3 to 4C, such as round (as shown) or quadratic or any other suitable form. In the exemplary embodiment illustrated in FIG. 5, the central aperture 512 has a shape that resembles that of a four-leaf clover in that there are four round concave recesses 514 positioned such that they lie between the thin rectangular electrodes 504. The rectangular electrodes 504 are closest to the straight portions of the inner contour of the central aperture 512. With this slightly more complex design, the area of overlap between the screen side face and the end-face of the large transverse dimension electrodes 502 can be kept at a high level, thereby effectively diminishing cross-talk. Moreover, any surface on which stray ions might impinge and cause electrostatic charging is set back from the ion beam passage in the inner width between the thin electrodes 504, thereby avoiding electric field distortions between the two electrode sets.

The number four of electrodes 504 and recesses 514 indicates that the design is intended for a quadrupole configuration. It goes without saying that multipole configurations with a higher number of electrodes, such as six, eight, ten, twelve, or even more electrodes, can also benefit from the advantageous screening effect facilitated by the present invention if the shape of the central aperture 512 of the screen 508 is adapted to this higher number.

Figure 6:
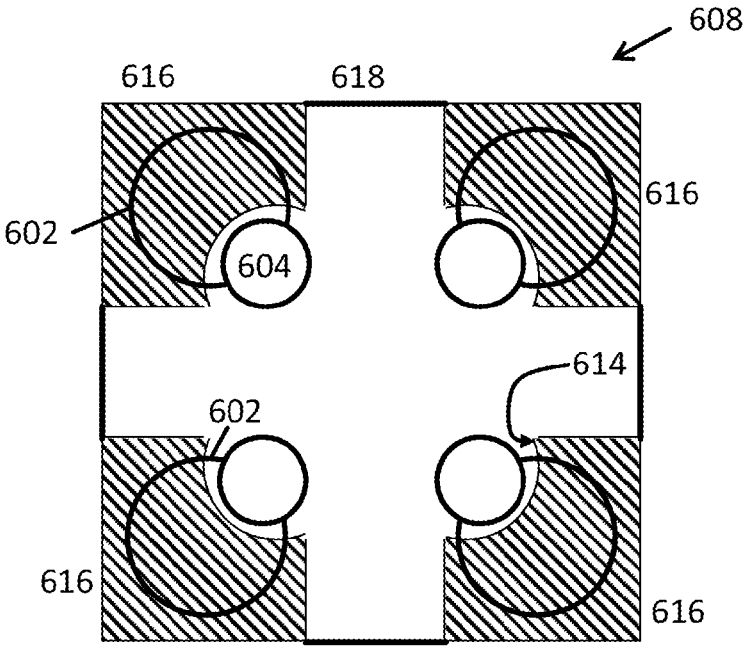

FIG. 6 shows another exemplary embodiment of the screen 608. In this case, it comprises four separate two-dimensional members 616 being shaped to, for one, neatly accommodate (circular) round small electrodes 604 at an inward facing contour 614, and, for another, provide for large overlap area with an electrode of large transverse dimension 602 located in the vicinity as to effectively intercept stray electric fields and thereby reduce cross-talk. The members 616 can be electrically connected via conductive bridges 618 so as to avoid inhomogeneous fields due to different potentials at the different members 616.

Figure 7:
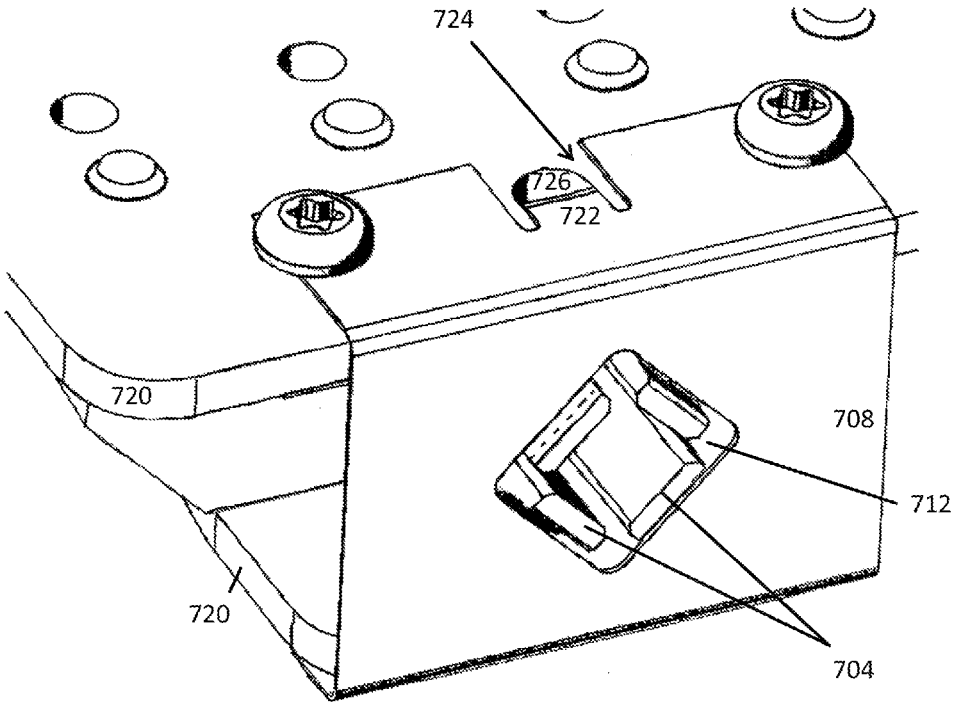
FIG. 7 illustrates a part of assembly according to principles of the invention comprising electrodes of small transverse dimension and an electric field screen in an isometric view.

FIG. 7 shows an implementation of an electric field screen 708 and the electrodes 704 of the first set having small transverse dimension. The electrodes 704 generally have almost quadratic cross section (not visible) along most parts of their extension, however are asymmetrically tapered or recessed to render thin and flat end sections which are then intended for being accommodated in the central aperture 712 of the screen 708. In so doing, a capacitive mass of the flat end sections of the electrodes 704, which contributes to the magnitude of capacitive coupling, can be reduced. The electrodes 704 are mounted between two plate-shaped, non-conductive substrates 720 in a sandwich-like arrangement. The screen 708, in this example, is a solid metal plate having two angled, flange-like portions at two sides thereof forming a type of bracket. At least one of the angled portions further has a lip 722 located in a recess 724 of the material, the lip 722 being in turn angled away from the angled portion and intended for engaging with an opening 726 in the upper substrate so as to afford precise and stable positioning. The bracket-like screen 708 is pulled over the lateral sides of the two substrates 720. In order to guarantee rigidity of the assembly the screen 708 can be additionally screwed to the substrate(s) 720. In this embodiment, the thin and flat end sections of the electrodes 704 are accommodated within the central aperture 712 such that the end-faces thereof are about flush with a side face of the screen 708 facing the opposing electrode set (not shown in this illustration).

The invention has been described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

What is claimed is:

1. An assembly of a first RF component and a second RF component in a mass spectrometer, the first RF component comprising a first set of electrodes and the second RF component comprising a second set of electrodes, wherein the RF components are located and aligned end-to-end to one another, and wherein a transverse dimension of the electrodes of the first set is smaller than that of the electrodes of the second set, the assembly further comprising a conductive electric field screen located at a radial outer periphery of the first set of electrodes and facing the electrodes of the second set such that it poses substantially no geometric restriction on a space between end-faces of the first and second set of electrodes, as to reduce RF electric field cross-talk between the electrodes of the first set and those of the second set.

2. The assembly of claim 1, wherein the electric field screen is maintained substantially at a DC bias potential applied uniformly to the electrodes of the first set.

3. The assembly of claim 1, wherein the electric field screen is one of grounded and supplied with at least one of tunable RF and tunable DC voltages.

4. The assembly of claim 3, wherein at least one of the tunable RF and tunable DC voltages supplied to the electric field screen is coordinated with at least one of RF and DC voltages supplied to the first or second set of electrodes.

5. The assembly of claim 1, wherein the first RF component is one of a multipole mass analyzer, a pre/post-filter, a multipole ion guide, a multipole collision cell, and a multipole ion trap and the second RF component is one of a multipole mass analyzer, a pre/post-filter, a multipole ion guide, a multipole collision cell, and a multipole ion trap.

6. The assembly of claim 1, wherein a longitudinal distance between the first and second sets of electrodes is smaller than an inscribed radius of an inner width formed in between the electrodes of one of the first set and the second set.

7. The assembly of claim 1, wherein the inner width formed in between the electrodes of the first set is different in one of shape and dimension from that formed in between the electrodes of the second set.

8. The assembly of claim 1, wherein the opposing front ends of the electrodes of at least one of the first set and second set are modified by one of being hollow and being recessed at a side facing away from the inner width formed in between the electrodes, as to decrease the conductive mass and thereby reduce a cross-talk magnitude.

9. The assembly of claim 1, wherein a side of the electric field screen facing the electrodes of the second set is positioned about flush with an end-face of the electrodes of the first set.

10. The assembly of claim 1, wherein the electric field screen is one of an integral sheet member and mesh member, having a central aperture with a dimension as to accommodate the electrodes of the first set.

11. The assembly of claim 10, wherein the central aperture resembles a clover leaf with a number of concave recesses that corresponds to a number of electrodes to be accommodated.

12. The assembly of claim 11, wherein the recesses and the electrodes of the first set are arranged in relation to one another such that the recesses lie between the electrodes of the first set.

13. The assembly of claim 10, wherein the central aperture is one of circular and rectangular.

14. The assembly of claim 1, wherein the electric field screen comprises a number of two-dimensional members that is equal to a number of electrodes in the first set, each two-dimensional member being associated with one of the electrodes of the first set.

15. The assembly of claim 1, wherein at least one non-conductive spacer is located between an outer circumference of the electrodes of the first set and the electric field screen.

16. The assembly of claim 1, wherein an end-face of a front end of the electrodes of the first set partially overlaps with that of the electrodes of the second set when viewed along an axis of the assembly.

17. The assembly of claim 1, wherein the first set and the second set of electrodes each comprise one of four, six, eight, ten, and twelve electrodes to form a quadrupole, hexapole, octopole, decapole, and dodecapole configuration, respectively.

18. A mass spectrometry apparatus comprising:

a first radio frequency (RF) component having a first set of elongate electrodes;

a RF component having a second set of elongate electrodes aligned end-to-end with the first electrode set and having a transverse dimension smaller than that of the first electrode set; and a conductive electric field screen located at a radial outer periphery of the first electrode set adjacent to the second electrode set such that it poses substantially no geometric restriction on a space between end-faces of the first and second set of electrodes and reduces RF electric field cross-talk between the electrode sets.

* * * * *